US006134839A

United States Patent [19]

Johansson

[11] Patent Number: 6,134,839

[45] Date of Patent: Oct. 24, 2000

[54] CLAMPING INJURY GUARD

[76] Inventor: Evald Johansson, 450 70 Hamburgsund, Sweden

[21] Appl. No.: 09/331,757

[22] PCT Filed: Dec. 23, 1997

[86] PCT No.: PCT/SE97/02207

§ 371 Date: Jul. 15, 1999

§ 102(e) Date: Jul. 15, 1999

[87] PCT Pub. No.: WO98/29634

PCT Pub. Date: Jul. 9, 1998

[30] Foreign Application Priority Data

Dec. 27, 1996 [SE] Sweden ..... 9604799

[51] Int. Cl.[7] ..... E05D 11/00

[52] U.S. Cl. ..... 49/383; 16/258

[58] Field of Search ..... 49/383, 384; 160/40; 16/258; 52/741.1, DIG. 12

[56] References Cited

U.S. PATENT DOCUMENTS

| | | | |
|---|---|---|---|
| 975,760 | 11/1910 | Freyberg . | |
| 1,444,994 | 2/1923 | White | 49/383 |
| 2,681,479 | 6/1954 | Dixon, Sr. | 49/383 |
| 2,681,480 | 6/1954 | Dixon, Sr. | 49/383 |
| 2,694,234 | 11/1954 | Roby et al. | 49/383 |
| 3,319,697 | 5/1967 | Krohn . | |
| 4,040,142 | 8/1977 | Ippolito | 16/137 |
| 4,344,253 | 8/1982 | Stiles | 49/383 |
| 4,845,892 | 7/1989 | Pinto | 49/383 |
| 4,878,267 | 11/1989 | Roach et al. | 16/250 |
| 5,092,077 | 3/1992 | Teinturier-Milgram | 49/383 |

FOREIGN PATENT DOCUMENTS 2523199 9/1983 France .

*Primary Examiner*—Daniel P. Stodola
*Assistant Examiner*—Curtis A. Cohen
*Attorney, Agent, or Firm*—Burns, Doane, Swecker & Mathis, L.L.P.

[57] ABSTRACT

A door-mounted injury guard for prevention of clamping injuries from closing doors. The injury guard includes guard rods which are positioned in such a manner that as calculated from below they cover at least a major part of the gap that forms between the door leaf and the door frame side, towards which the door leaf pivots. In addition, the guard has a plate which is pivotally mounted on the same door frame side adjacent a gap that widens as the door opens. The plate resiliently abuts against the door leaf and bridges the entire gap in each and every open position of the door.

1 Claim, 3 Drawing Sheets

CLAMPING INJURY GUARD

TECHNICAL FIELD

BACKGROUND OF THE INVENTION

The invention concerns a door-mounted device serving as a guard for prevention of clamping injuries in connection with door closing movements.

Each door is a potential source of injuries inasmuch as the door, when being opened, forms a gap between the door leaf and the door frame on the door-suspension or hinge side. It easily happens that one or a couple of fingers are inadvertently introduced into the gap thus formed and are seriously injured, should the door close before the fingers are withdrawn. This danger is particularly imminent in the case of small children playing on the floor adjacent an open door. The child may be on the outside of the door and happen to introduce some of his fingers or a hand into the gap as he is about to get up and in doing so supports himself by placing his other hand on the door leaf, thus closing the door without first retracting his fingers from the gap. Also grown-ups may, of course, easily find themselves in an equivalent situation.

The devices hitherto presented to solve this problem do, however, fail to be entirely satisfactory, which has strongly contributed to the non-existing use of any construction of this nature in any doors of any kind in any one environment.

SUMMARY OF THE INVENTION

The present invention provides a guard which offers total protection against clamping injuries on the door hinge or suspension side, where the risks of injuries potentially are the highest. The features characterising the inventive guard are defined in the appended claims.

BRIEF DESCRIPTION OF THE DRAWING

The invention will be described in closer detail in the following with reference to the accompanying drawings, wherein.

DETAILED DESCRIPTION OF THE INVENTION

The guard in accordance with the invention comprises guard rods 1*a,* 1*b,* 1*c*. Preferably they are formed as hollow circular rods made from metal, plastics or wood, the choice being dependent on the appearance and nature of the door. The guard rods 1*a,* 1*b,* 1*c* are attached to the suspension or hinge side of the door in such a manner that, calculated from below, they cover at least the major part of the gap 2, see FIG. 6, that forms between the door leaf 3 and the door frame 4 on the suspension side 5 of the frame 4.

Figure 5:
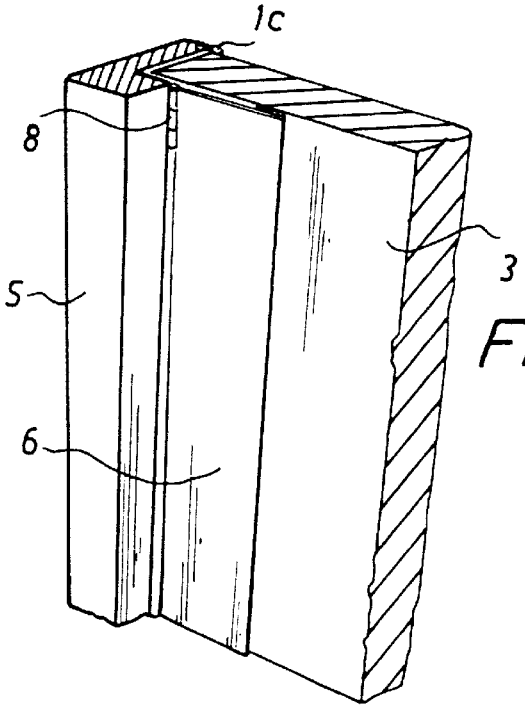
FIGS. 5, 6 and 7 are perspective views of a part of the door that is fitted with the guard, the door leaf being shown in different open positions.
Figure 6:
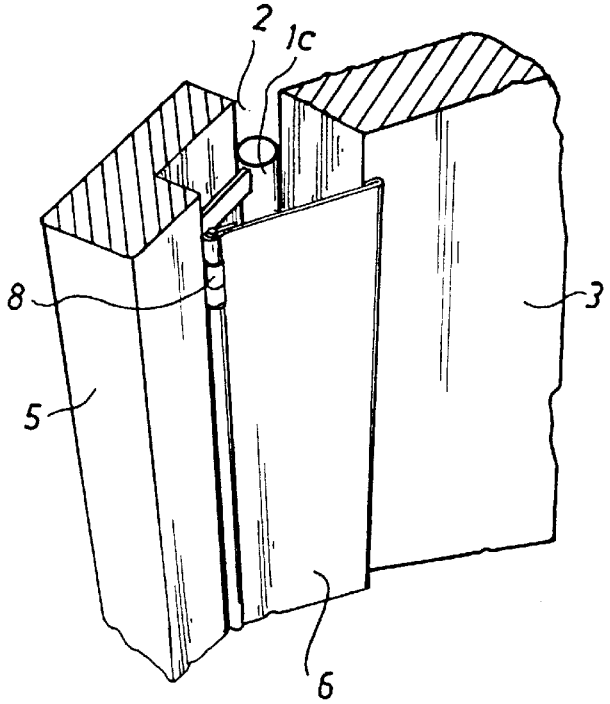
Figure 7:
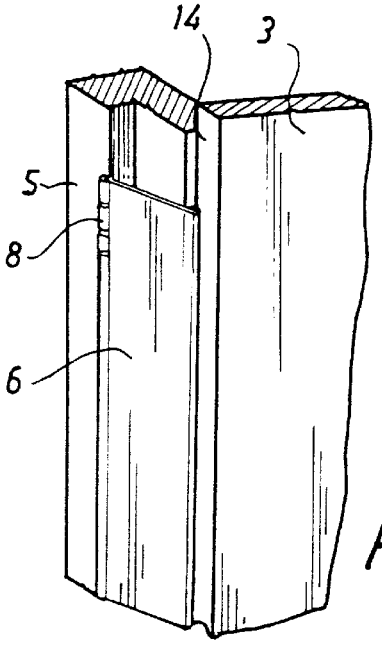

The guard also includes a plate 6 which is pivotally mounted in hinges 7, 8 on the same door frame side 5 adjacent the gap, see FIGS. 5–7, that widens as the door opens. At least one of the hinges, in accordance with the embodiment illustrated in the drawings hinge 8, is equipped with a spring 9 tending to urge the plate 6 against the door leaf 3 in any open position of the latter.

Figure 1:
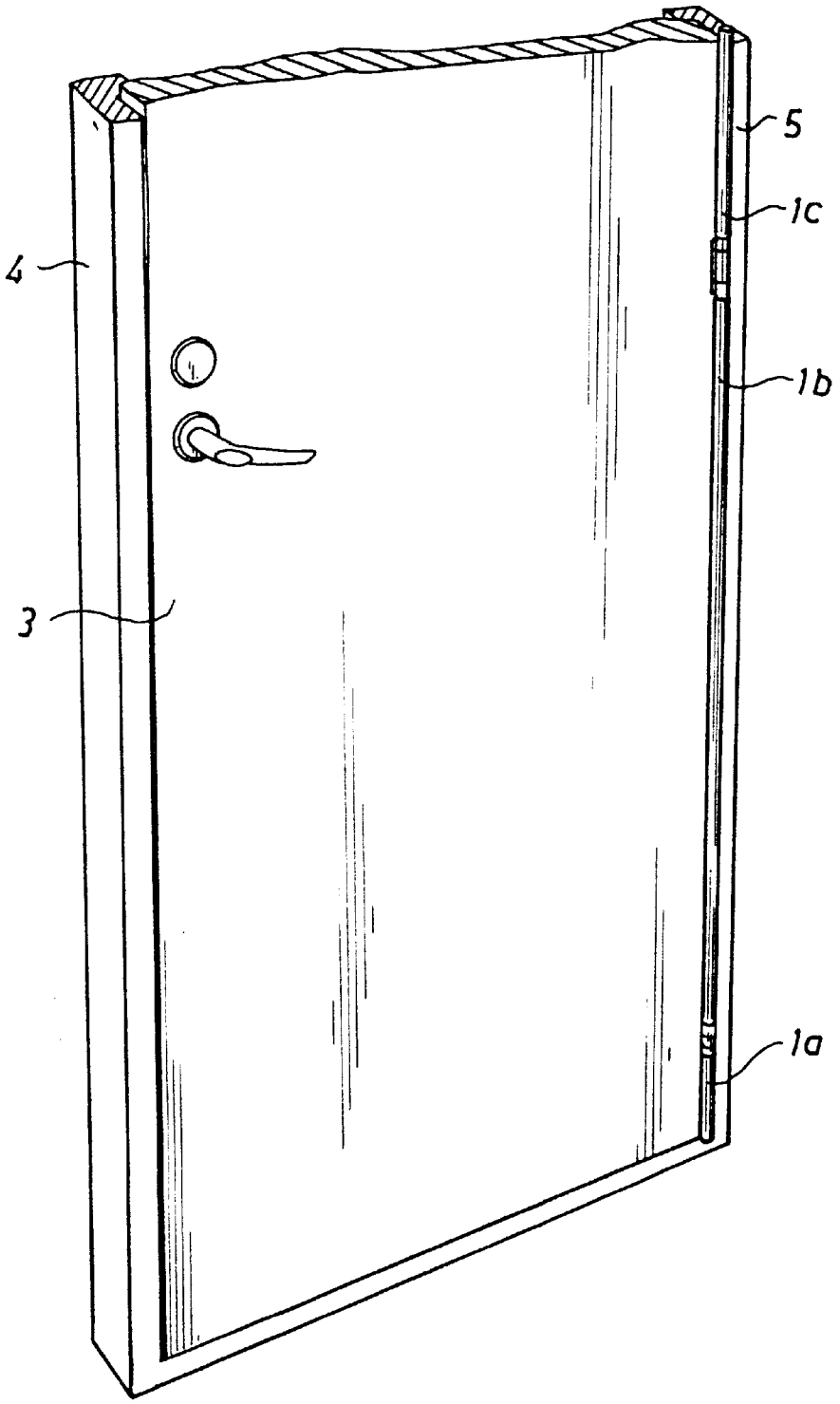
FIG. 1 is a perspective view of a part of a door and its associated frame.
Figure 2:
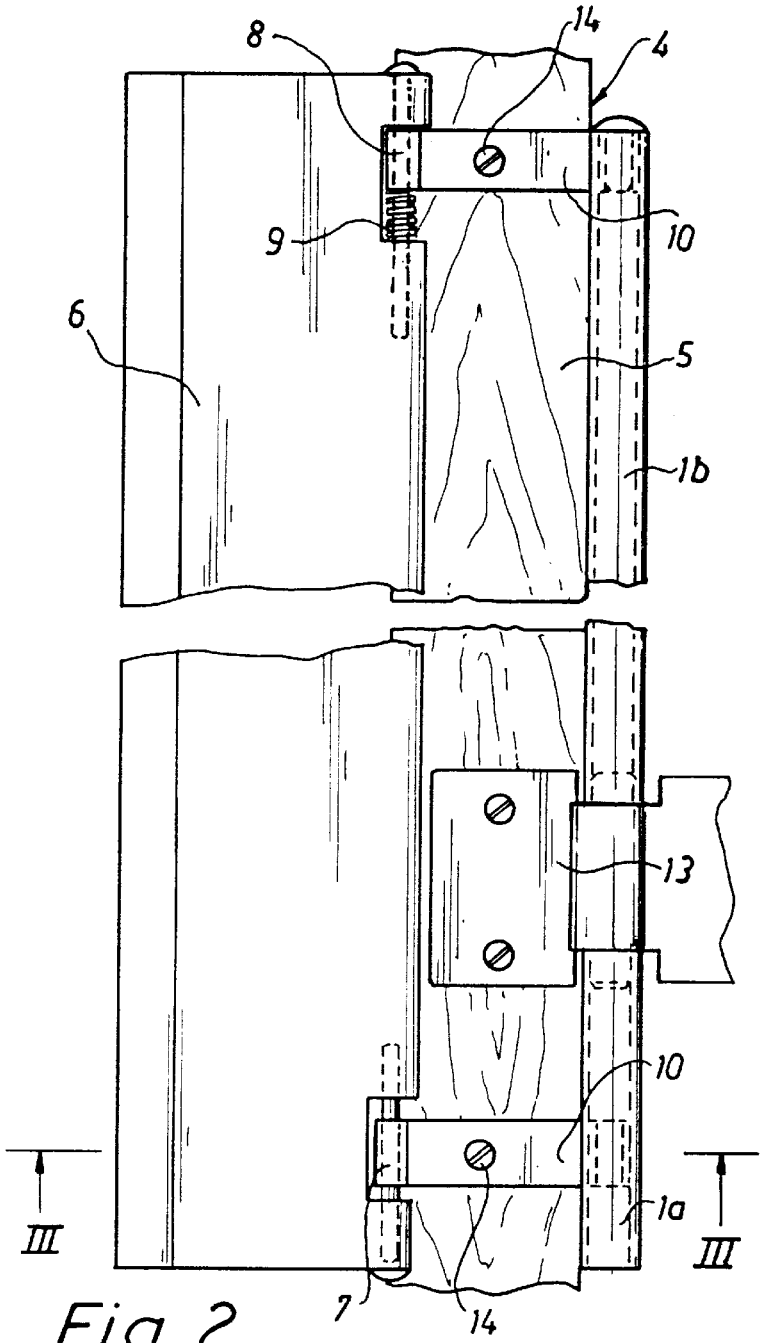
FIG. 2 is a view on a larger scale of a part of the frame fitted with the guard in accordance with the invention.
Figure 4:
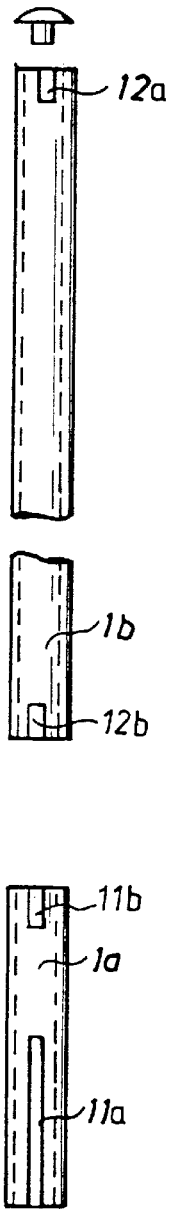
FIG. 4 is a view of a part of the guard as seen from the side.
Figure 3:
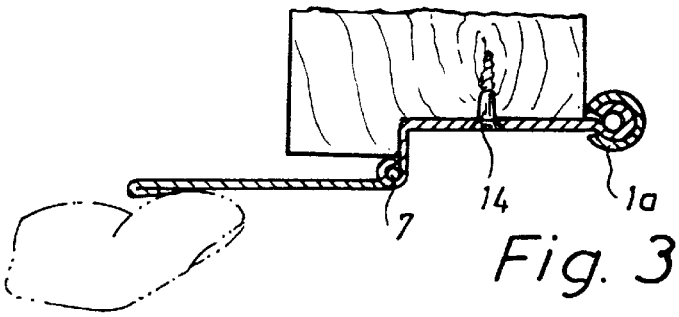
FIG. 3 is a sectional view on line III—III of FIG. 2.

The guard rods 1*a,* 1*b,* 1*c* and the plate 6 are interconnected by means of fittings 10 that may be screwed to the door frame 4. As illustrated in FIG. 4, which shows only guard rods 1*a* and 1*b,* rod 1*a* is formed with a downwardly open slit 11*a* and an upwardly open slit 11*b* whereas rod 1*b* is formed with an upwardly open slit 12*a* and a downwardly open slit 12*b*.

Fitting the guard in accordance with the invention to a door is a very simple task. The rod 1*a* is passed from underneath onto the lowermost hinge 13 of the door with the aid of the slit 11*b*. Thereafter, the lowermost fitting 10 associated with the plate 6 is introduced through the slit 11*a* and moved upwards inside the hollow rod 1*a* as far as possible. The rod 1*b* is then passed from above onto the same hinge 13 with the aid of the slit 12*b,* whereupon the uppermost fitting 10 is introduced into the slit 12*a* and pushed down into rod 1*b,* also hollow. Each fitting 10 may then be secured to the frame 4 by means of its individual screw 14, and that concludes the fitting of the guard.

The guard in accordance with the invention provides excellent protection against clamping injuries at the suspension or hinge side of a door. The guard rods 1*a,* 1*b,* 1*c* are arranged sufficiently close to the gap 2 not to allow a finger, not even a child's finger, to reach into the gap, whether the door is open or closed. The plate 6 rests against the door leaf 3 while being subjected to moderate spring bias. When the door is closed, see FIG. 5, the plate 6 projects somewhat in over the door leaf 3. When the door opens, the plate 6 slides against the door leaf 3 while abutting lightly thereon, see FIG. 6, until the door is completely open, in which case the plate 6 pivots inwards towards the inner lengthwise edge face 14 of the door leaf 3, see FIG. 7. Consequently, the plate 6 bridges the gap between the frame side 5 and the door leaf 3 in each and every open position of the door, preventing inadvertent introduction of for instance a hand or a foot into said gap. When the door again closes, the plate 6 slides along the door leaf 3, abutting equally lightly thereon, back to the original position illustrated in FIG. 5.

The invention is not limited to the embodiment as shown and described herein but may be varied in many ways within the scope of the appended claims. This is true as regards the construction and design of the guard rods 1*a,* 1*b,* 1*c* and the plate 6 and the choice of the material of these components. In addition, the spring 9 could of course be configured differently from the helical spring illustrated in the drawings.

What is claimed is:

1. A door-mounted injury guard assembly comprising:

a door frame and a door leaf pivotally mounted about at least one pivot member within said door frame for preventing clamping injuries caused by the closing door;

a plurality of guard rods for mounting on the door frame so as to cover at least a portion of a gap formed between the door leaf and the door frame, the guard rods being mounted on the frame, towards which the door leaf is pivoted, and a plate pivotally mounted separate from the at least one pivot member on the frame adjacent the gap, which widens as the door opens, the plate resiliently abutting against the door leaf so as to completely bridge the gap in each and every open position of the door, and wherein the guard rods and the plate are interconnected by fitting members secured to the frame.

* * * * *